United States Patent [19]

Hoexter

[11] 4,019,434

[45] Apr. 26, 1977

[54] MOUNTING-PROOFING MACHINE FOR FLEXOGRAPHIC PLATES

[75] Inventor: Rolf Hoexter, Engelwood, N.J.

[73] Assignee: Mosstype Corporation, Waldwick, N.J.

[22] Filed: Apr. 1, 1976

[21] Appl. No.: 672,771

[52] U.S. Cl. ..... 101/216; 101/DIG. 12; 33/184.5

[51] Int. Cl.[2] ..... B41F 5/00

[58] Field of Search ..... 101/DIG. 12, 401.3, 101/212, 216, 219; 33/184.5

[56] References Cited

UNITED STATES PATENTS 3,242,694 3/1966 Schmidt ..... 64/19 X

OTHER PUBLICATIONS

M15 Mosstype Mounter–Proofer Maintenance and Instruction Manual, Rev. June, 1975, Mosstype Corp. of Waldwick, N.J.

*Primary Examiner*—J. Reed Fisher

[57] ABSTRACT

A machine to facilitate the mounting of flexographic printing plates and for obtaining proofs thereof. The machine includes an impression cylinder supported for rotation at a fixed position, the impression cylinder making contact with printing plates on a plate cylinder and rotating concurrently therewith to print a proof secured to the impression cylinder. The plate cylinder is movable in a vertical plane from a proofing state in which it makes contact with the impression cylinder to a mounting state in which it is separated therefrom. A viewer is provided which is operative in the mounting state to show the operator both the plate he is mounting on the plate cylinder and the image reflected from the proof sheet on the impression cylinder. In order to merge these two images so that the operator sees exactly where to lay the plate on the plate cylinder, means are provided which mechanically interlink the two cylinders to effect a relative adjustment of their angular positions whereby a given point on the plate cylinder is optically coincident with the corresponding point printed on the impression cylinder.

8 Claims, 13 Drawing Figures

D1
PDC
D2
S1
12
S2
D3
14
10
13

MOUNTING-PROOFING MACHINE FOR FLEXOGRAPHIC PLATES

BACKGROUND OF INVENTION

This invention relates generally to machines to facilitate the mounting of flexographic printing plates and for obtaining proofs thereof, and more particularly to a mounting-proofing machine of relatively simple, low-cost design capable of handling plate cylinders in a large range of diameters.

In the flexographic process, printing is effected by rubber printing plates mounted on cylinders, the paper to be printed being impressed on the inked printing plate. The cylinder on which the printing plates are mounted is generally called the plate cylinder. The quality of a flexographic printing job depends, in large measure, on the care with which pre-press preparations are carried out. Plate-mounting, color registration and proofing are effected off the press by means of commercially available mounting-proofing machines designed for this purpose.

These machines, which usually make use of an optical mounting system, make it possible to mount the plates on plate cylinders to effect exact color-registration, a procedure essential to the maintenance of both quality and economy in all flexographic operations. Pre-proofing is, in many respects, the most important of all pre-press preparations, for it not only indicates the appearance of the final reproduction, but it also affords means to check the mounting of the plates for color sequence, spacing requirements, layout and gear size, as well as copy and color separation.

Mounting-proofing machines are provided with a proofing cylinder (sometimes called the impression cylinder) which cooperates with the plate cylinder, the proofing cylinder making contact with the printing plates on the plate cylinder and rotating concurrently therewith to print a proof on a sheet secured to the proofing cylinder. In commercial machines of the type which are presently available, the proofing or impression cylinder is supported for rotation at a fixed position, whereas the plate cylinder is movable in a vertical plane, from a mounting state in which it is retracted relative to the proofing cylinder to a proofing state in which it is in engagement therewith. One such machine is the M15 Mounter-Proofer manufactured by the Mostype Corporation of Waldwick, New Jersey, the assignee of the present application.

The M15 machine includes a single element, line-of-sight viewer which shows the operator both the plate he is mounting on the plate cylinder and an image reflected from the proof sheet on the impression cylinder. By simply merging the two images, the operator sees exactly where to lay the plate on the plate cylinder. The entire viewer assembly automatically raises out of the way, giving unobstructed access to the plate cylinder for close inspection, inking, etc. The viewer returns automatically to the identical viewing position when ready to proceed with mounting.

The impression and plate cylinders are provided with respective gears of the same diameter. These gears are mechanically intercoupled, whereby rotation of the proofing cylinder causes the plate cylinder to rotate in both the mounting state when the cylinders are separated and in the proofing state when the cylinders are in engagement with each other.

When the diameter of the proofing cylinder is the same as the printing diameter of the plate cylinder (i.e., the diameter of the plate cylinder plus the thickness of the printing plates thereon), then a one-to-one relationship exists therebetween. In practice, however, the plate cylinders come in a range of diameters for different size printing jobs. This is a direct function of plate cylinder circumference which equals the pitch line circumference of the plate cylinder gear. It is necessary, therefore, in the M15 machine and in other mounting-proofing machines operating on similar principles to adjust the phase relationship between the plate and proofing cylinders to accommodate the differences between the cylinder diameters.

In order to mechanically interlink the plate cylinder and impression cylinder gears so that rotation of one cylinder results in rotation of the other regardless of their relative positions and for adjusting the phase relationship for different plate cylinder diameters, existing types of mounting-proofing machines requires a relatively complex mechanism which adds substantially to the cost thereof.

SUMMARY OF INVENTION

In view of the foregoing, the main object of this invention is to provide a mounting-proofing machine of simple and efficient design for accurately and quickly mounting and proofing flexible printing plates on a plate cylinder preparatory to operation in a flexographic printing press.

More specifically, it is an object of this invention to provide a mounting-proofing machine having an impression cylinder whose gear is linked thereto by a parallel displacement coupling, such that rotation of the impression cylinder gear produces a like rotation off the impression cylinder regardless of the position of the axis of the impression cylinder gear relative to the parallel axis of the impression cylinder.

Also an object of the invention is to provide a machine of the above type in which the impression cylinder gear is linked to the impression cylinder by means of a parallel displacement coupling and in which the impression cylinder gear engages the plate cylinder gear of the plate cylinder and is supported for rotation by an arm which is shiftable to cause the impression cylinder gear to ride on the plate cylinder gear and to rotate to an extent bringing about a phase correction, as a result of which a print point on the impression cylinder is optically coincident in a viewer with a print point on the plate cylinder.

Briefly stated, these objects are attained in a mounting-proofing machine in which an impression cylinder mounted for rotation on a first shaft about a fixed horizontal axis cooperates with an impression cylinder gear of the same diameter which is mounted for rotation on a second shaft about a horizontal axis which is movable relative to the fixed axis from a position coaxial thereto to a displaced parallel position. The first and second shafts are interlinked by a parallel displacement coupling whereby rotation of the impression cylinder results in a corresponding rotation of the impression cylinder gear in the same direction regardless of the displaced position of the gear axis.

Also provided is a plate cylinder mounted for rotation on a third shaft about a horizontal axis which is movable relative to the fixed axis from a position in which the plate and impression cylinders are in contact with each other to a position in which the cylinders are separated. A plate cylinder gear of the same diameter as the plate cylinder is also mounted on the third shaft, the plate cylinder gear intermeshing with the impression cylinder gear whereby rotation of the impression cylinder results in rotation of the plate cylinder in a reverse direction to an extent determined by the ratio of the impression cylinder and plate cylinder gears.

Means are provided to elevate the plate cylinder and the plate cylinder gear coupled thereto from a mounting state in which the plate cylinder is separated from the impression cylinder to a proofing state in which the plate cylinder makes contact with the impression cylinder, whereby a print point on the plate cylinder is then physically coincident with a print point on the impression cylinder.

In order to make possible optical coincidence of the two print points in a viewer which is operative in the mounting state, the impression cylinder gear shaft is mounted for rotation at the end of an arm extending from a crank, whereby to effect a phase correction in the position of the print point on the impression cylinder the arm is shifted to cause the impression gear to ride on the plate cylinder and to rotate to an extent bringing about the required correction.

OUTLINE OF DRAWINGS

For a better understanding of the invention as well as other objects and further features thereof, reference is made to the following detailed description to be read in conjunction with the accompanying drawings, wherein:

FIG. 1 schematically illustrates the relationship of the impression and plate cylinders in the proofing state in a mounting-proofing machine in accordance with the invention;

FIG. 2 schematically illustrates the relation of these cylinders in the mounting state;

FIG. 13 is a simplified view of the phase-correcting mechanism.

DESCRIPTION OF INVENTION

Figure 1:
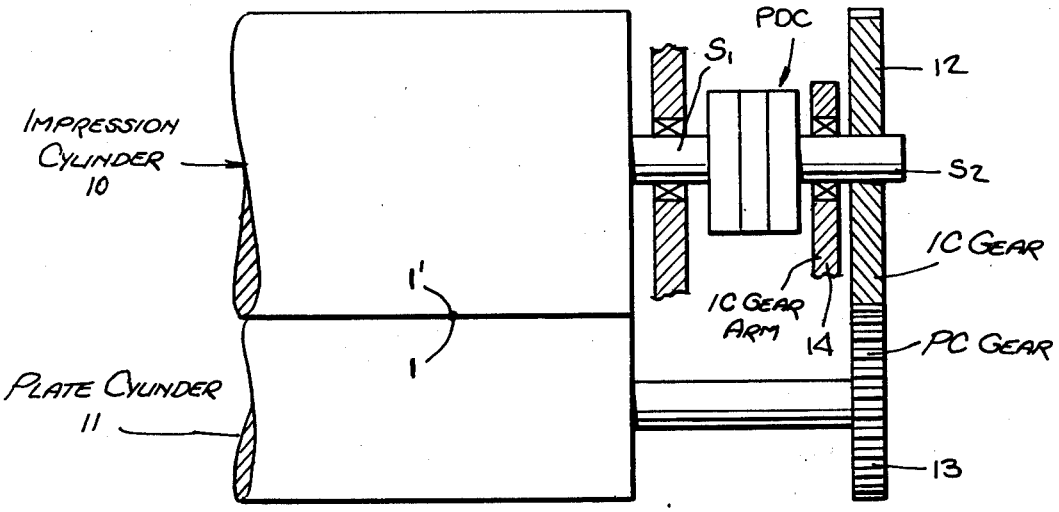
Figure 2:
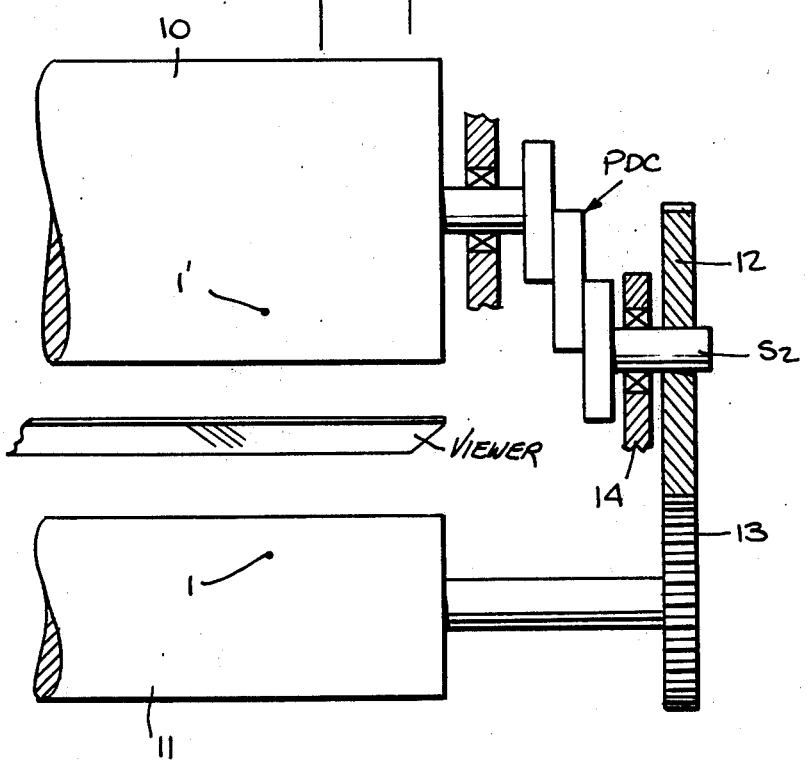

Referring now to FIGS. 1 and 2, there is shown schematically the main components of a mounting-proofing machine in accordance with the invention. The machine includes an impression cylinder 10 of large diameter which is mounted for rotation about a fixed horizontal axis on a first shaft $S_1$ which may or may not be integral with the impression cylinder.

Associated with impression cylinder 10 is an impression cylinder (IC) gear 12 of the same diameter mounted for rotation about a horizontal axis on a second shaft $S_2$, the second shaft being movable from a position in which it is coaxial with the first shaft to a parallel position displaced from the first shaft. Shaft $S_2$ of the IC gear is mechanically interlinked to shaft $S_1$ of the impression cylinder by means of a parallel displacement coupling, generally designated as PDC, so that rotation of IC gear 12 results in like rotation of the impression cylinder regardless of the relative positions of the two shafts and without generating perturbing forces or torques.

Also provided is a plate cylinder 11 of whatever diameter is appropriate to the flexographic job to be performed. The plate cylinder is rotatable about a parallel horizontal axis on a third shaft $S_3$ which is movable in a vertical plane which is displaced from the fixed horizontal axis, the plate cylinder being shiftable from a proofing state, as shown in FIG. 1, to a mounting state as shown in FIG. 2.

In the proofing state, as shown in FIG. 1, shaft $S_1$ and $S_2$ are axially aligned, and IC gear 12 and impression cylinder 10 are concentric, whereby a given angular displacement of the IC gear about its axis results in exactly the same angular displacement of the impression cylinder. In the mounting state, as shown in FIG. 2, shaft $S_2$ of the IC gear is parallel to shaft $S_1$ of the impression cylinder, so that the IC gear is now out of line with the impression cylinder. Nevertheless, a given angular displacement of the IC gear results in exactly the same angular displacement of the impression cylinder.

Mounted on shaft $S_3$ of plate cylinder 11 is a plate cylinder (PC) gear 13 of the same diameter. The PC gear travels with the plate cylinder and is always concentric therewith, whereby a given angular displacement of PC gear 13 results in exactly the same angular displacement of plate cylinder 11.

PC gear 13 always remains in intermeshing relationship with IC gear 12, so that in either the proofing or the mounting state, a rotation of impression cylinder 10 in one direction is transmitted by the parallel displacement coupling PDC to IC gear 12 and by way of PC gear 13, produces a rotation of plate cylinder 11 in the reverse direction to an extent determined by the ratio of these gears.

Thus if impression cylinder 10 is turned clockwise, plate cylinder 11 is caused to turn in the counterclockwise direction. Shaft $S_2$ of IC gear 12 is supported for rotation in a bearing at the free end of a swingable impression cylinder gear arm 14, so that when plate cylinder 11 shifts from its proofing state to its mounting position, as a consequence of which IC gear 12 is lowered from its initial position concentric with the impression cylinder, arm 14 is caused to swing downwardly in an arc.

The other end of the swingable impression cylinder gear arm 14 is pivotally connected to a crank 15 operated by a pneumatic cylinder 16 or functionally equivalent means so that the arm may be shifted axially to a predetermined extent limited by stops, thereby causing IC gear 12 carried thereby to shift in the same direction. Assuming that PC gear 13 is kinematically locked against rotation, then when IC gear 12 which engages PC gear 13 is shifted by arm 14, IC gear 12 is caused to ride on the PC gear and to rotate, this rotation being transmitted to impression cylinder 10 (see FIGS. 3 to 6).

A viewer V is provided having a partial mirror, the viewer being reacted in the proofing state and being brought into an operative position in the mounting state, as shown in FIG. 2. In the operative position of viewer V, the operator is able to see in the mirror both the surface of impression cylinder 10 and the surface of plate cylinder 11, these surfaces appearing in superposed relation.

When, in the proofing state, plate cylinder 11 makes contact with impression cylinder 10, as shown in FIG. 1, a print point on the printing plate carried by the plate cylinder will be impressed on the proof sheet carried by the impression cylinder. This print point, as it appears on the plate cylinder, will be referred to as print point 1, and the physically coincident point appearing on the impression cylinder will be identified as print point 1'.

In order to obtain optical coincidence between the images of print points 1 and 1' in viewer V when these points are separated from each other in the mounting state of the cylinders, it is necessaary to rotate the two cylinders to cause these points to merge in viewer V. The manner in which this is accomplished by the mechanism which interlinks the two cylinders will now be explained in connection with FIGS. 3 to 6.

Figure 3:
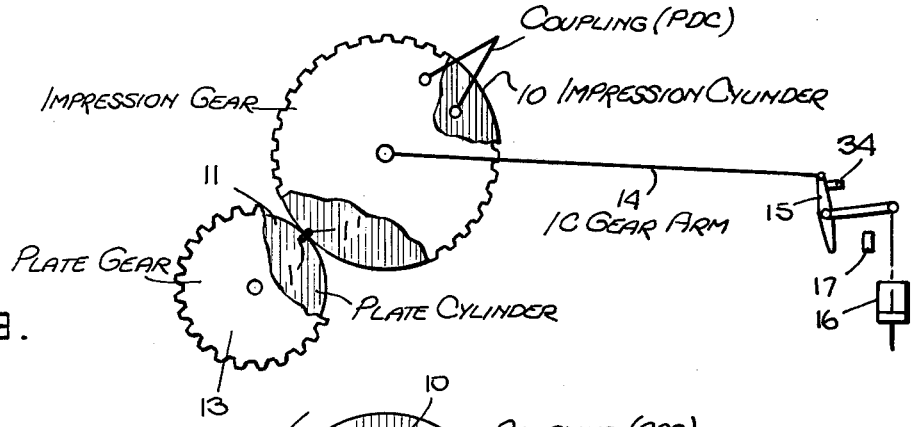
FIG. 3 is a sketch showing the relationship of the impression and plate cylinders and the gears associated therewith in the proofing state wherein a print point on the plate cylinder is physically coincident with a print point on the impression cylinder.

FIG. 3 illustrates the relationship existing between impression cylinder 10 and plate cylinder 11 in the proofing state. In this state, IC gear 12 is concentric with impression cylinder 10, the gear being supported at the end of impression cylinder gear arm 14. Plate cylinder 11 is now in contact with impression cylinder 10 to effect a proofing action in which the print point 1 on plate cylinder 11 is physically coincident with point 1' on impression cylinder 10.

Figure 4:
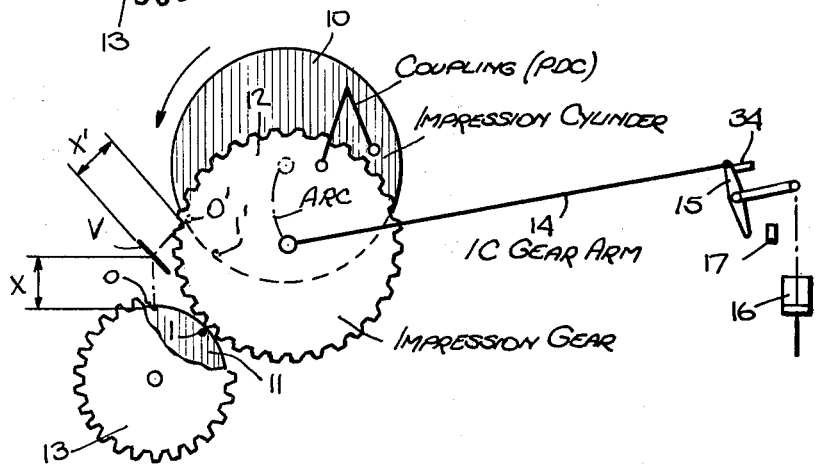
FIG. 4 is a sketch showing the relationship which exists between the impression and plate cylinders when the plate cylinder is lowered to occupy the mounting state and the viewer is in its operative position to observe observation sites on the cylinder.
Figure 5:
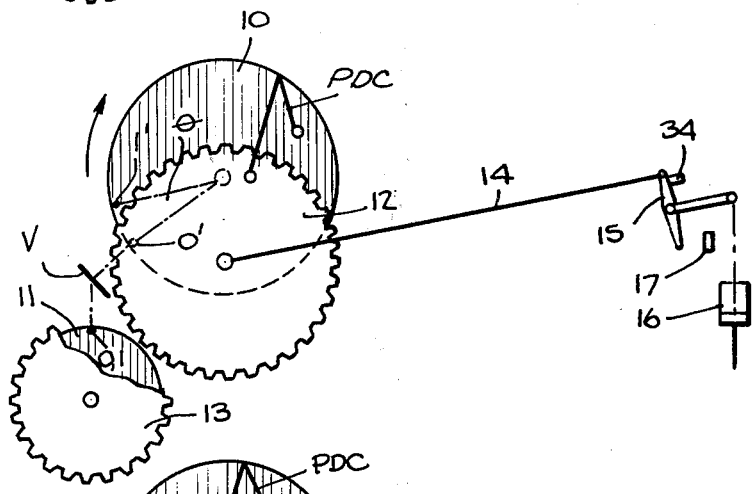
FIG. 5 is a sketch showing the relationship which exists in the mounting state after the plate cylinder has been turned to locate the print point thereon at its proper observation site with respect to the viewer, as a consequence of which the print point on the impression cylinder is phaseshifted relative to its proper observation site.

FIG. 4 illustrates the relationship of the cylinders in the mounting state after plate cylinder 10 has been lowered and viewer V is in its operative position. As plate cylinder 11 descends in a vertical plane, point 1 therein remains at the same angular position, but point 1' on impression cylinder 10 is angularly displaced in the counterclockwise direction to an extent determined by the gear ratio between PC gear 13 and IC gear 12, for as PC gear 13 is lowered, arm 14 swings downwardly through an arc ARC, causing IC gear 12 to rotate in the counterclockwise direction with respect to PC gear 13 which is effectively locked in position.

In order to bring about optical coincidence between points 1 and 1' in the mounting state, it is necessary that these points be brought in observation sites 0 and 0', respectively. Site 0 in FIG. 4 is at zero degrees on plate cylinder directly below the optical axis of viewer V, and it is spaced therefrom by a distance X. Site 0' on the impression cylinder is an equal distance X' from the optical axis of viewer V, this site lying at the intersection of a line from this optical axis and the tangent of the impression cylinder. The angle defined by the plane of the viewer mirror and the line extending to site 0 is equal to the angle defined by the same plane and the line extending to site 0'.

To bring print point 1 on plate cylinder 11 to observation site 0, one must rotate plate cylinder 11 and PC gear 13 coupled thereto in the counterclockwise direction, as shown in FIG. 15, until print point 1 is at zero degrees. Print point 1 is now properly placed with respect to viewer V. But in so turning plate cylinder 11 and PC gear 13, this causes IC gear 12 and impression cylinder 10 coupled thereto by the PDC coupler to turn in the clockwise direction to a degree determined by the gear ration. As a consequence, print point 1' on the impression cylinder overshoots observation site 0'.

The resultant phase displacement $\theta$ between print point 1' on the impression cylinder and observation site 1' represent the extent of correction required to bring the print point to its proper position relative to viewer V. The required amount of correction depends on the relative diameters of the cylinders, so that a phase correction for a plate cylinder of a particular diameter is inappropriate to a plate cylinder of a different diameter.

Figure 6:
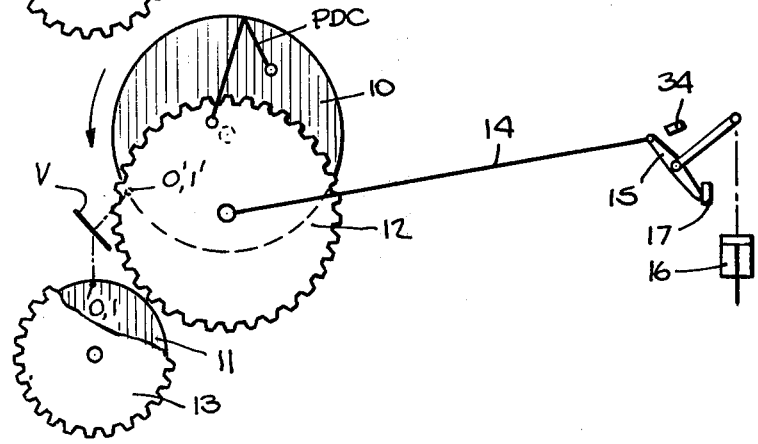
FIG. 6 is a sketch showing the relationship which exists in the mounting state after the impression cylinder has been turned to correct for the phase shift, thereby causing the print point thereon to occupy its proper observation site, whereby now both print points are optically coincident in the viewer.

To effect the required correction for different plate cylinders, swing arm 14 is shifted axially by crank 15 which is driven by pneumatic cylinder 16, as illustrated in FIG. 6. Since plate cylinder 10 and PC gear 13 coupled thereto are kinematically locked to maintain print point 1 at observation site 0, in shifting arm 14 axially, IC gear 12 is forced by the arm to ride on PC gear 13 and to rotate in the counterclockwise direction. Because PC gear 113 is linked by parallel displacement coupling PDC to impression cylinder 10, this cylinder undergoes a corresponding counterclockwise rotation.

The shift of arm 14 is arrested by an adjustable mounting position 17 which engages the foot of crank 15 at a point at which print point 1' on the impression cylinder occupies the observation site 0', so that now print points 1 and 1' are optically coincident in viewer V. Inasmuch as different phase corrections are required for plate cylinders of different diameters, each time a cylinder of different diameter is installed in the mounting-proofing machine, an appropriate adjustment of stop 17 must be made. The shift of arm 14 in the proofing position is arrested at the same point by a fixed stop 34 associated with the upper end of the crank.

We shall now summarize the procedure for operating the mounting-proofing machine.

First, plate cylinder 11 is raised to the proofing state in which a print point 1 on plate cylinder 11 makes contact with the impression cylinder to produce a coincident print point 1' thereon.

Second, plate cylinder 11 is lowered to its mounting state and viewer V is brought down into its operative position at which an observation site 0 on plate cylinder 11 is optically coincident with an observation site 0' on impression cylinder 10. But print point 1 on the plate cylinder is not at site 0 nor is print point 1' on the impression cylinder at site 0'.

Third, plate cylinder 11 is turned until print point 1 thereon occupies observation site 0, as a result of which print point 1' on impression cylinder 10 is carried to a site which overshoots observation site 0' thereon.

Fourth, cylinder 16 is actuated to force arm 14 which carries IC gear 12 to shift to an extent limited by stop 17 to cause gear 12 to turn impression cylinder 10 to an extent bringing print point 1′ thereon to observation site 0′, whereby print points 1 and 1′ are now optically coincident in viewer V.

Structure of Machine

Figure 7:
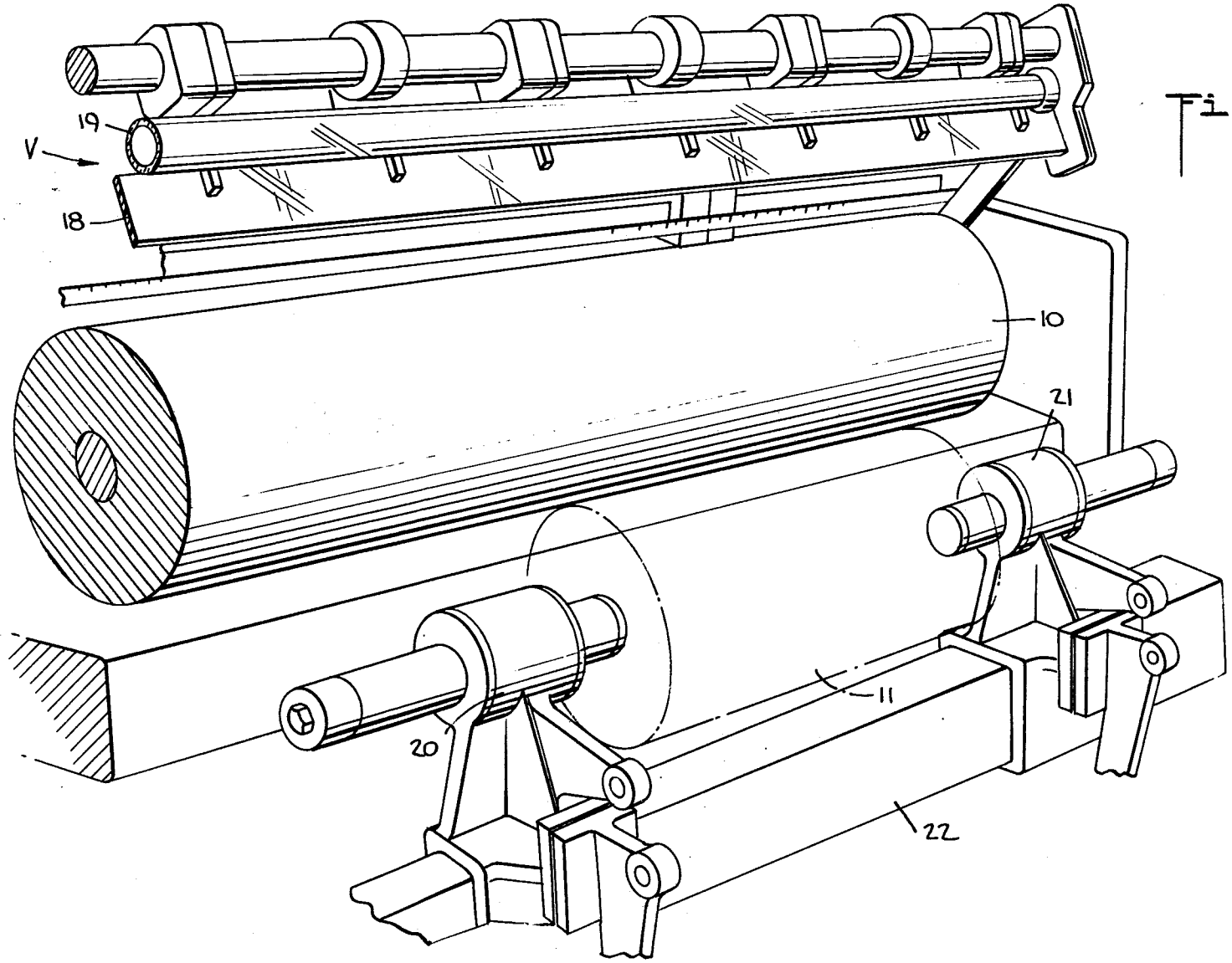
FIG. 7 is a perspective view of the mounting-proofing machine in the proofing state.

Referring to FIG. 7, the mounting-proofing machine in accordance with the invention is shown with the viewer V in its retracted state, the viewer including a partial mirror 18 and a fluroescent light tube 19 to illuminate the images being viewed. Plate cylinder 11, which is shown in dotted lines, is held between a pair of chucks 20 and 21, which are slidable along an elevator beam 22 to accommodate the space between chucks to the length of the plate cylinder held thereby. A PC gear which is not shown in FIG. 7 is attached coaxially to the right-hand chuck 21 so that this gear turns together with the plate cylinder.

Elevator beam 22 is mechanically operated to raise and lower the plate cylinder 11, as required, into contact with impression cylinder 10 in the proofing state and separately therefrom in the mounting system. A penumatic cylinder is provided to swing viewer V down into its operative position in the proofing state.

Figure 8:
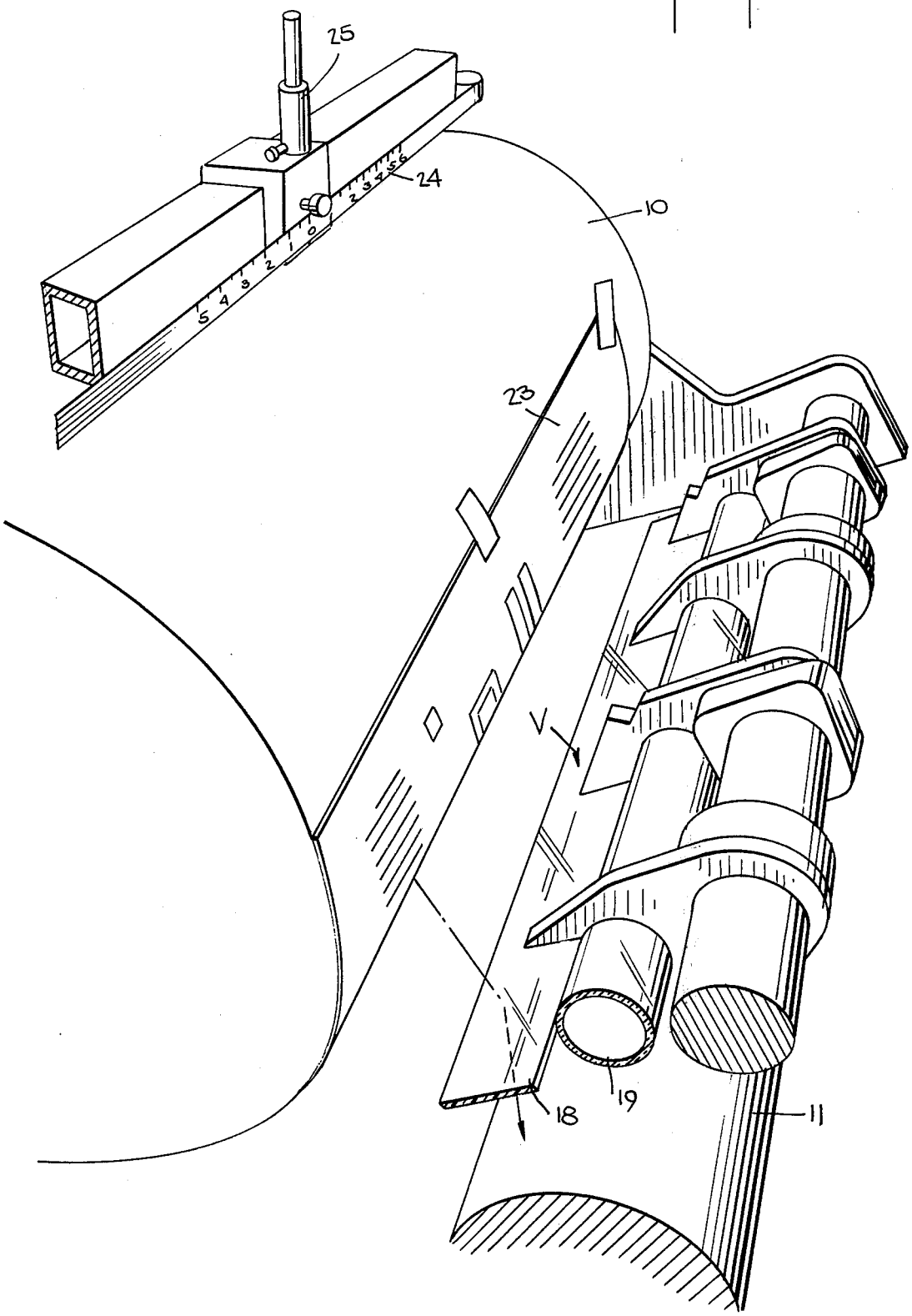
FIG. 8 is a perspective view of the same machine in the mounting state.

As shown in FIG. 8, a proof sheet 23 is taped to impression cylinder 10. Accurate layouts for the first down or key color may be drawn quickly and without difficulty by means of a calibrated band ruler 24 and marking pen 25. Graduated in both directions from zero, the band ruler can be moved to set the zero point whenever desired.

Figure 9:
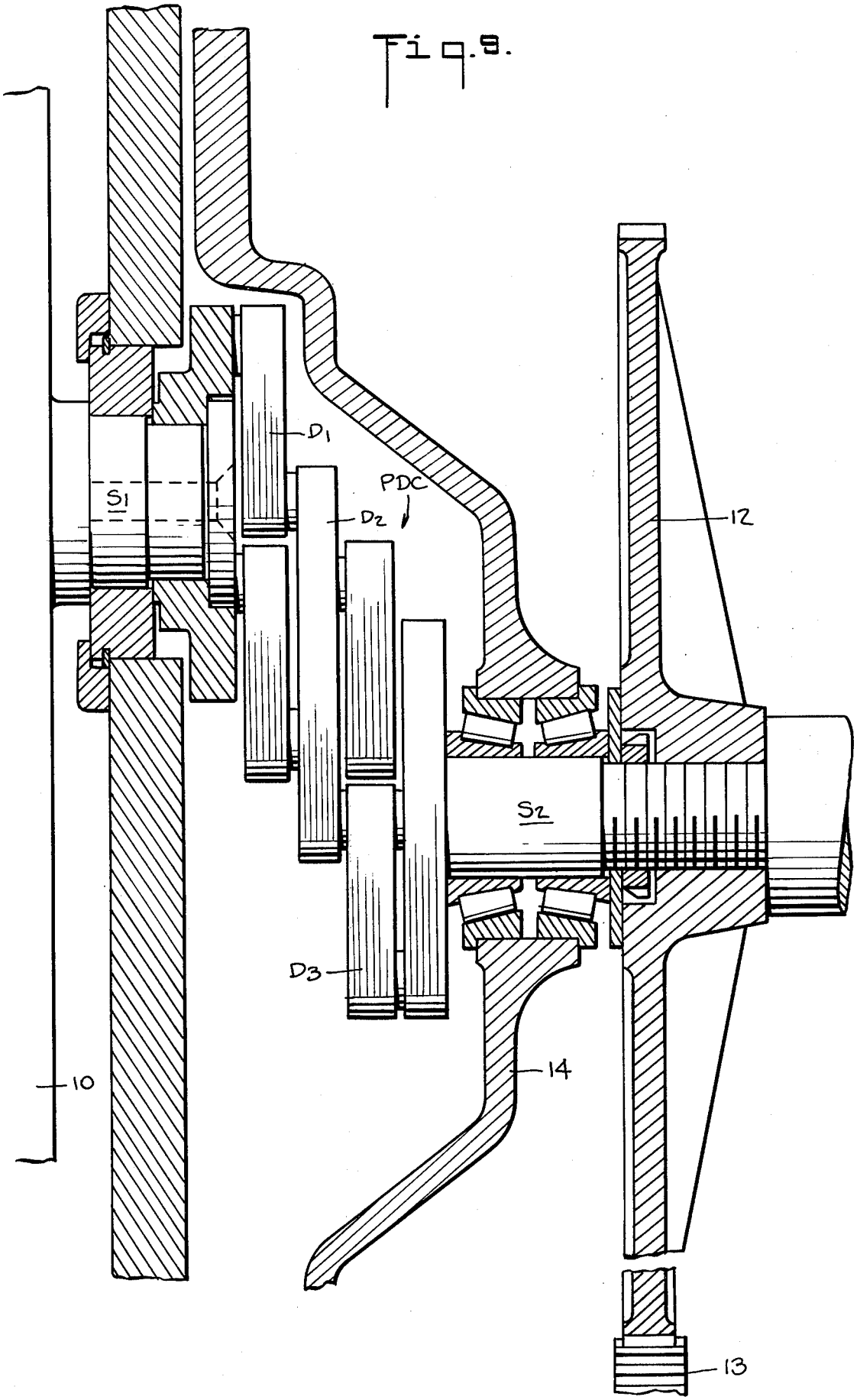
FIG. 9 is an elevational view of the parallel displacement coupling which interlinks the impression cylinder to the impression gear of the machine.

Referring now to FIG. 9, there is shown the parallel displacement coupling PDC which links IC gear 12 on shaft $S_2$ to shaft $S_1$ of impression cylinder 10. Shaft $S_2$ of the IC gear is supported in a pair of tapered roller bearings at the end of swing arm 14. It will be seen that IC gear 12 intermeshed with PC gear 13 therebelow.

Figure 10:
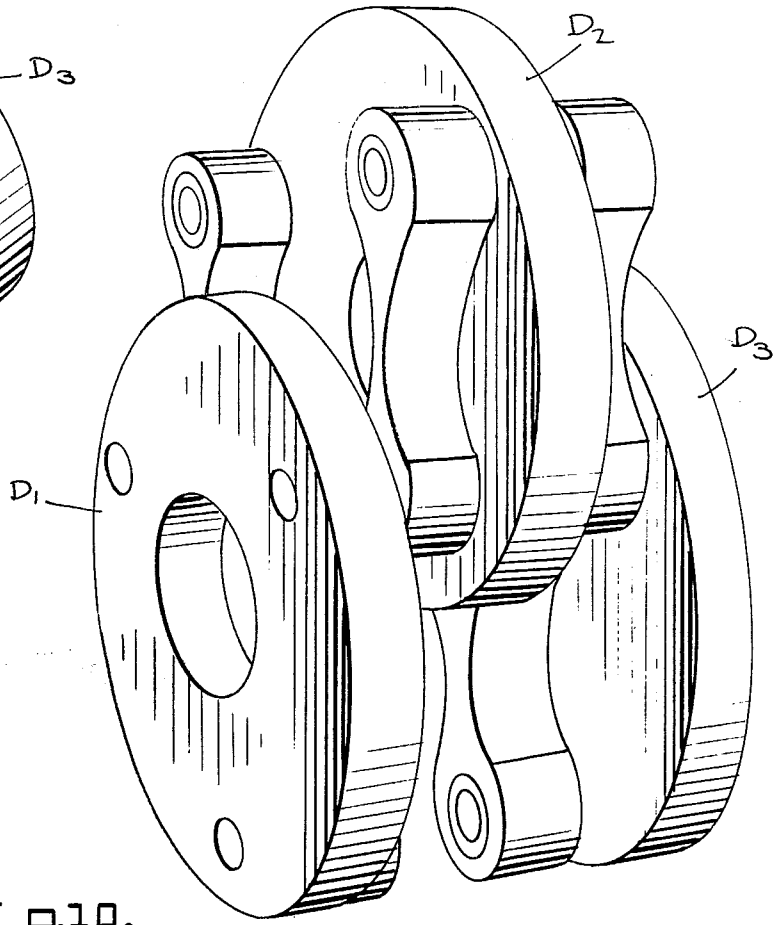
FIG. 10 is a perspective view of the parallel displacement coupling.
Figure 11:
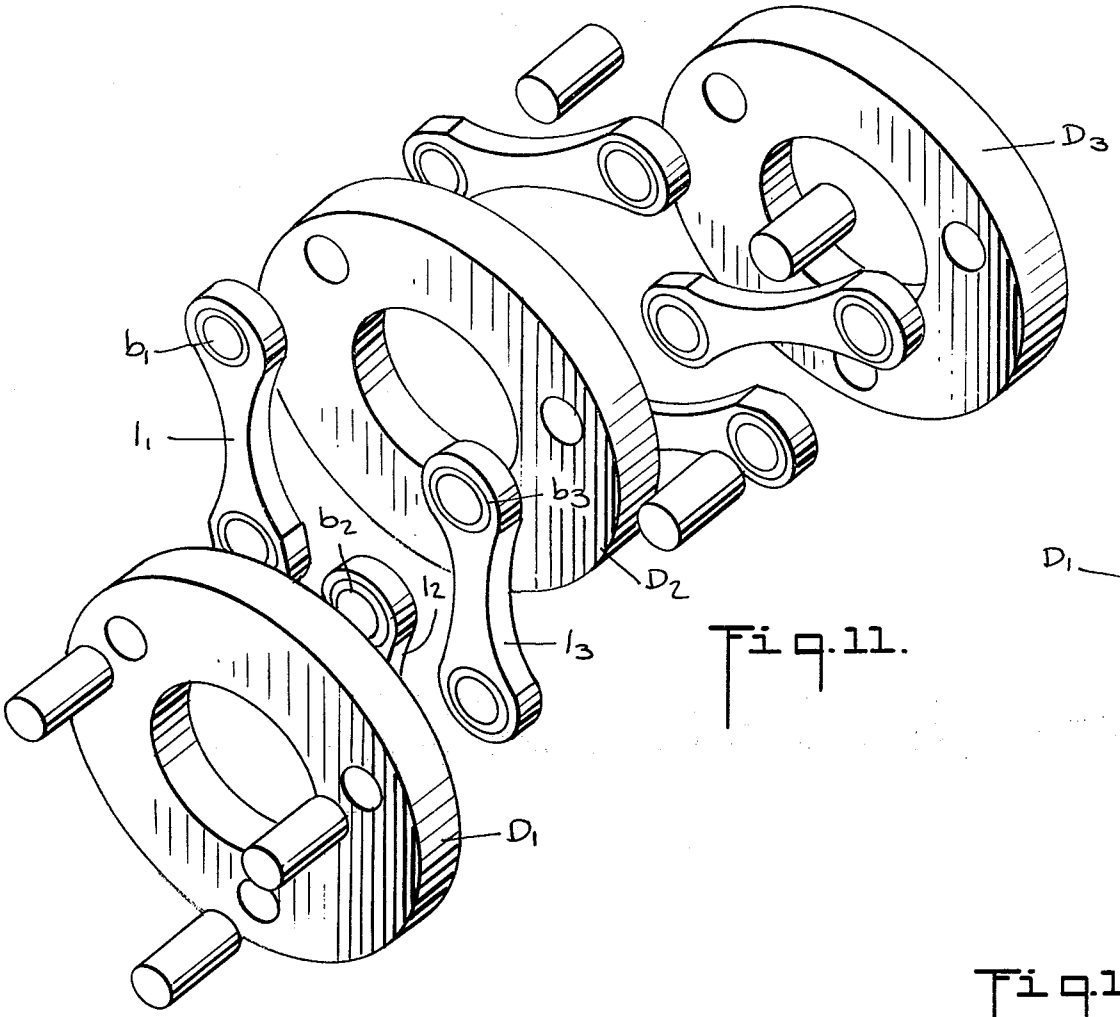
FIG. 11 is an exploded view of the coupling.

The PDC coupling is preferably of the type known commercially as a "Schmidt Coupling" manufactured by The Tool Steel Gear and Pinion Company of Cincinnati, O., and described in their bulletin 666. This coupling, as shown separately in FIGS. 10 and 11, consists essentially of a first or driving disc $D_1$ mounted at the end of the drive shaft which in this instance is shaft $S_1$ of the impression cylinder. The outer face of driving disc $D_1$ carries three cantilevered bearings $b_1$, $b_2$ and $b_3$ equidistant from the center and 120° apart. The bearings $b_1$ to $b_3$ are supported by three links $l_1$, $l_2$ and $l_3$ of equal length. The three links operate in a single plane and have three corresponding bearings on the rear face of the second or intermediate disc $D_2$.

Intermediate disc $D_2$ is thus driven in rotation by driving disc $D_1$. Intermediate disc $D_2$ also carries three similar links and bearings on its opposite face to drive the third or driven disc D, which is mounted on the output shaft which, in this instance, is shaft $S_2$ of IC gear 12. All three discs rotate with equal velocity in the same direction. Each set of three links acts as radius rods, forcing the axes of the two discs they join to remain a fixed distance apart.

Therefore, as the distance between the parallel shafts $S_1$ and $S_2$ is altered, intermediate disc $D_2$ compensates therefor by moving laterally with a toggle motion. With such motion, there is no phase shift between input and output shafts $S_1$ and $S_2$ and the coupling can accommodate any radial motion about fixed shaft $S_1$ as long as the coupling transmits torque without introducing any force and torque perturbations.

Figure 12:
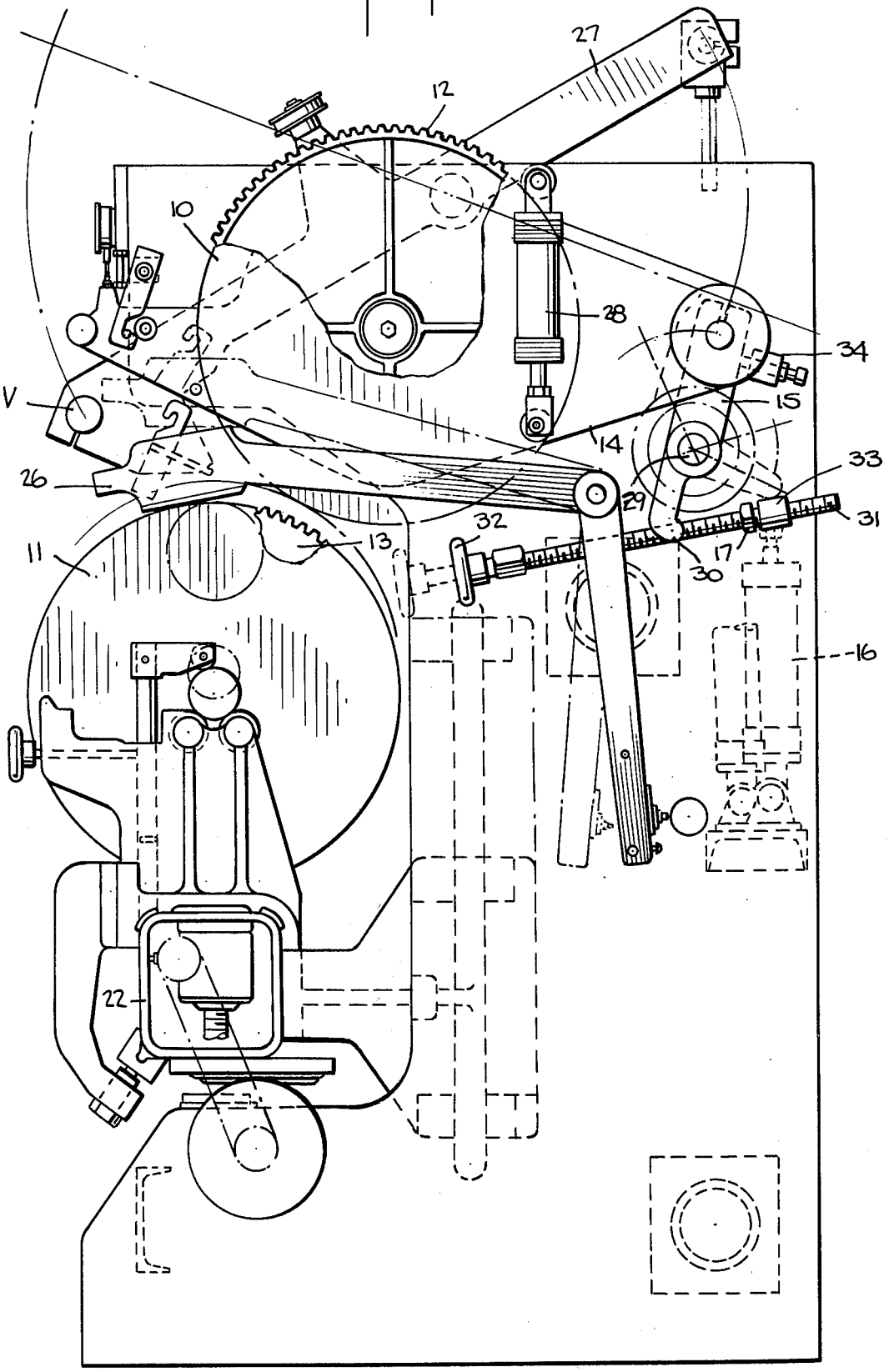
FIG. 12 is an end view of the machine showing the phase-correcting mechanism.
Figure 18:
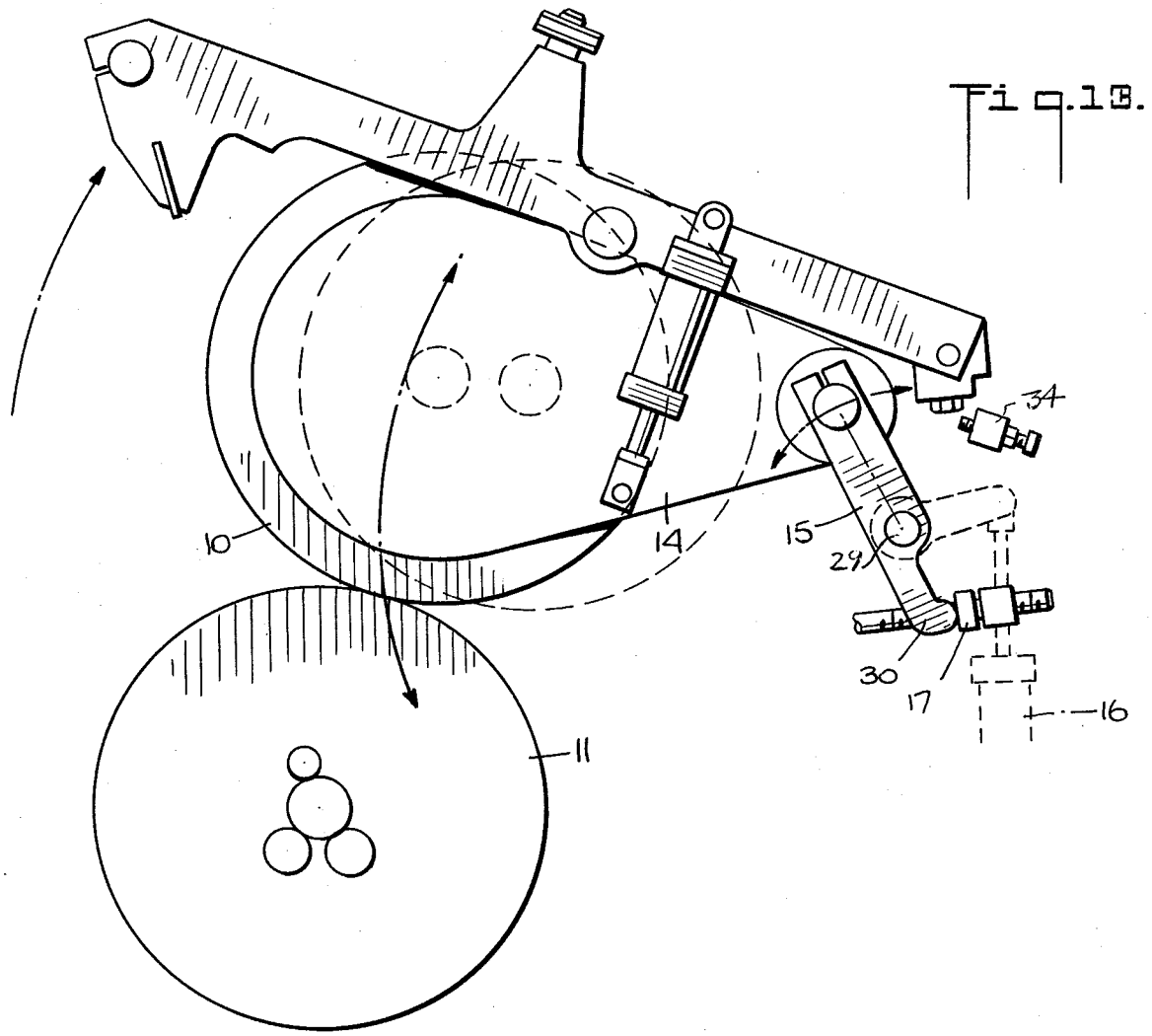

Referring now to the end view of FIG. 12 and to the simplified view in FIG. 13, plate cylinder 11 is shown in contact with impression cylinder 10; hence in this state, IC gear 12 is concentric with impression cylinder 10. Plate cylinder 11, which is raised to its proofing state by elevator beam 22, cooperates with a sensing arm 26 which is arranged to actuate a switch so as to de-energize the elevator motor when the plate cylinder reaches its proper mounting position. For sensing the proper proofing position, gear arm 14 carries a limit switch actuator (not shown).

Retractable viewer V is mounted at the end of pivoted arms 27 which is operated by a pneumatic cylinder 28, the cylinder raising the viewer above the impression cylinder in the proofing state and bringing it down into its operative position when the plate and impression cylinder are in the mounting state.

It will be seen that crank 15, to which one end of IC gear arm 14 is coupled, is mounted to rock with respect to a fixed pivot point 29, the crank having an extension finger 30 which cooperates with stop 17 whose setting determines the extent of phase correction. Stop 17 is mounted on a threaded bolt 31 having a handle 32 attached to its head, so that by manually turning this bolt with respect to a stationary sleeve 33 threadably engaging the bolt, the position of stop 17 relative to finger 30 may be adjusted. It will also be seen that crank 15 is operatively coupled to pneumatic cylinder 16, whereby when this cylinder is actuated, IC gear arm 14 is shifted to cause IC gear 12 to ride on PC gear 13 and to rotate to an extent necessary to effect the required phase correction.

While there has been shown and described a preferred embodiment of a mounting-proofing machine in accordance with the invention, it will be appreciated that many changes and modifications may be made therein without, however, departing from the essential spirit thereof.

I claim:

1. A flexographic mounting-proofing machine comprising:

A. an impression cylinder rotatable on a first shaft about a fixed horizontal axis;

B. an impression cylinder gear having the same diameter as the impression cylinder and rotatable on a second shaft and a swingable arm for supporting said second shaft about a horizontal axis which as the arm swings is displaced with respect to the fixed axis of the impression cylinder from an initial position in which the two axes are coaxial with each other to a displaced parallel position;

C. a parallel displacement coupling interlinking thre first and second shafts whereby rotation of the impression cylinder results in a corresponding rotation of the impression cylinder gear regardless of the position of the second shaft relative to the first shaft;

D. a plate cylinder rotatable on a third shaft about a horizontal axis parallel to the fixed axis;

E. a plate cylinder gear mounted for rotation on said third shaft and having the same diameter as said plate cylinder whereby rotation of the plate cylinder gear results in a corresponding rotation of the plate cylinder, said plate cylinder gear intermeshing with said impression cylinder gear whereby rotation of said impression cylinder is transmitted by said coupling to said plate cylinder and results in rotation of the plate cylinder in the reverse direction to an extent determined by the ratio of said gears;

F. elevator means to raise said plate cylinder and the plate cylinder gear associated therewith from a mounting state in which said plate cylinder is separated from said impression cylinder to a proofing state in which said plate cylinder makes contact with said impression cylinder and a print point on said plate cylinder is physically coincident with a print point on said impression cylinder;

G. a retractable viewer, and means to shift the viewer to a retracted position in the proofing state and to an operative position in the mounting state in which the viewer occupies a position in which an observation site on said plate cylinder is optically coincident with an equidistant observation site on said impression cylinder, and H. means to shift said arm to an extent causing said impression cylinder gear to ride on said plate cylinder gear and to rotate, the rotation of the impression cylinder gear and to rotate, the rotation of the impression cylinder gear being transmitted by the coupling to the impression cylinder to cause the print point on the impression cylinder to occupy the observation site thereon.

2. A machine as set forth in claim 1, wherein said coupling includes a driving disc coupled to the impression cylinder gear shaft, a driven disc coupled to the impression cylinder gear shaft, and an intermediate disc so linking the driving and driven discs whereby rotation of the impression cylinder results in a corresponding rotation of the impression cylinder gear.

3. A machine as set forth in claim 1, wherein said viewer is constituted by a partial mirror and means to illuminate the portions of the cylinders viewed by the mirror.

4. A machine as set forth in claim 1, wherein said elevator means includes an elevator beam and chucks slidable on said beam to support the ends of said plate cylinder.

5. A machine as set forth in claim 1, wherein the means to shift the arm is a crank which is rockable about a fixed pivot point.

6. A machine as set forth in claim 5, further including a pneumatic cylinder to actuate said crank.

7. A machine as set forth in claim 5 includng a fixed stop to limit the movement of the crank in the proofing state.

8. A machine as set forth in claim 5 including an adjustable stop to limit the movement of the crank in the mounting state.

* * * * *

UNITED STATES PATENT OFFICE

CERTIFICATE OF CORRECTION

Patent No. 4,019,434 Dated April 26, 1977

Inventor(s) Rolf Hoexter

It is certified that error appears in the above-identified patent and that said Letters Patent are hereby corrected as shown below:

Column 2, line 36 change "off" to -- of --
Column 5, line 17 change "reacted" to -- retracted --
Column 6, line 9 change "15" to -- 5 --
line 15 change "ration" to -- ratio --
line 34 change "113" to -- 13 --
Column 7, line 10 change "fluroescent" to -- fluorescent --
line 23 change "penumatic" to -- pneumatic --
line 37 change "intermeshed" to -- intermeshes --
line 55 change "D" to -- $D_3$ --
line 66 after "as" second occurrence, insert -- the movable shaft $S_2$ remains parallel thereto. Thus --
Column 8, line 53 change "thre" to -- the --
Column 9 lines 21 and 22 delete "the rotation of the impression cylinder gear and to rotate,"
Column 10 line 3 delete "gear"

Signed and Sealed this second Day of August 1977

[SEAL]

Attest:

RUTH C. MASON
Attesting Officer

C. MARSHALL DANN
Commissioner of Patents and Trademarks